US006510640B2

(12) United States Patent
Strong

(10) Patent No.: US 6,510,640 B2
(45) Date of Patent: Jan. 28, 2003

(54) TRIGGER LOCK SYSTEM

(76) Inventor: Tom J. Strong, 1889 W. Queen Creek Rd., #2054, Chandler, AZ (US) 85248

( * ) Notice: Subject to any disclaimer, the term of this patent is extended or adjusted under 35 U.S.C. 154(b) by 0 days.

(21) Appl. No.: 09/840,316

(22) Filed: Apr. 23, 2001

(65) Prior Publication Data

US 2002/0152661 A1 Oct. 24, 2002

(51) Int. Cl.[7] ..... F41A 17/00
(52) U.S. Cl. ..... 42/70.07; 42/70.01
(58) Field of Search ..... 42/70.01, 70.07

(56) References Cited

U.S. PATENT DOCUMENTS 2,893,152 A * 7/1959 Peluso ..... 42/70.06
3,164,919 A * 1/1965 Hall ..... 236/15 R
3,422,560 A * 1/1969 Foote et al. ..... 42/70.06
3,978,604 A * 9/1976 Smith ..... 42/70.06
4,105,885 A * 8/1978 Orenstein ..... 200/42.02
4,110,928 A * 9/1978 Smith ..... 42/66
4,354,189 A * 10/1982 Lemelson ..... 340/10.33
4,488,370 A * 12/1984 Lemelson ..... 42/70.01
4,723,370 A * 2/1988 Sheehan ..... 42/70.07
5,461,812 A * 10/1995 Bennett ..... 42/70.06
5,704,152 A * 1/1998 Harrison et al. ..... 42/70.07
5,755,054 A * 5/1998 Tuller ..... 42/70.07
5,832,647 A * 11/1998 Ling et al. ..... 42/70.07
5,918,402 A * 7/1999 Weinraub ..... 42/70.07
6,055,759 A * 5/2000 Langner ..... 42/70.07
6,343,429 B1 * 2/2002 Mossberg et al. ..... 42/70.01

* cited by examiner

*Primary Examiner*—Michael J. Carone
*Assistant Examiner*—Denise J Buckley
(74) *Attorney, Agent, or Firm*—Schmeiser, Olsen & Watts

(57) ABSTRACT

A one-piece trigger lock adapted to be inserted into a trigger guard of a gun is disclosed. The trigger lock has a keyway into which a key may be engaged for moving the lock mechanism between the locked and release positions. The key may be a ring-key. The key can unlock the trigger lock by pressing against the keyway.

The trigger lock may have a safety feature which may include multiple lock-pins, a design which prevents the trigger lock from being disassembled unless it is in the unlocked position, or a behind-the-trigger safety wedge.

A method for using the trigger lock is also disclosed. The method includes the steps of releasing the locking mechanism of the trigger lock, moving the trigger lock from the locked to the release position, pushing the trigger lock away from the trigger guard area of a gun, and placing the trigger finger inside the trigger guard area in one swift, fluid, easy motion.

10 Claims, 5 Drawing Sheets

TRIGGER LOCK SYSTEM

BACKGROUND OF THE INVENTION

1. Technical Field

This invention generally relates to a trigger lock device which can be locked and unlocked using a key which may be a ring.

2. Background of the Invention

One of the most important aspects of gun safety is the safe storage of firearms when they are not in use. Children or other unauthorized users frequently find guns and accidentally or intentionally discharge them. Trigger locks are devices which are inserted into the trigger guard area of a gun. When engaged and locked, trigger locks make it impossible to pull the gun's trigger and, in most cases, make it impossible to discharge the weapon. Trigger lock devices have been used to ensure the safe storage of guns.

Some existing trigger locks can be pried away from the trigger guard or picked open using screwdrivers or other key substitutes. And, if the trigger lock locks with a key and the key is carelessly stored, a determined child or other unauthorized user may be able to find the key, use the key to unlock a trigger lock and cause injury.

Trigger locks can be awkward to use. If firearms are kept for personal safety reasons, it is often a great concern to be able to remove the trigger lock quickly in the event of sudden fear for one's personal safety. If great care is taken to store the key separately from the firearm, to prevent determined children from finding the key for example, it might take precious time to search for and retrieve the key, use it to unlock the trigger lock, remove the trigger lock and operate the weapon. Often, trigger locks are not used while storing a gun because of this potential delay.

Trigger locks can also be awkward to use by their design. Some trigger locks are two-piece units. Some of these two piece units must be screwed together and others must be aligned and locked together using a key. To use these two-piece trigger locks, a first half of the trigger lock mechanism must be carefully aligned around the trigger and trigger guard. Then, a second half of the trigger lock must be carefully aligned with its first complimentary half, which often requires the alignment of several oddly placed pins and recesses. Finally, the two halves must be affixed to each other. This may require screwing one half down onto the other half or locking the two halves with a key, while carefully holding the two halves in alignment around the gun's trigger. Unlocking these two halves can be equally awkward. Unlocking may require unscrewing one half from the other and using a key while holding the gun, then catching the released half of the trigger lock when it falls free of the gun and removing the key from the lock. Trigger locks designed in these ways virtually require that the operator put the gun down at some point during the process of removing the trigger lock.

Therefore, there exists a need for a practical trigger lock which can lock and unlock a gun easily and quickly. There is a need for a trigger lock which does not require complicated locking of two separate halves of a lock around a trigger guard. And, there is a need for a trigger lock which can operate with a key which is easily accessible to the gun owner but not easily accessible to a child or an unauthorized user.

SUMMARY OF THE INVENTION

A one-piece trigger lock which is adapted to be inserted into a trigger guard of a gun comprising a lock mechanism movable between a locked position and a release position is disclosed herein. When the trigger lock is inserted into a trigger guard of a gun and the lock mechanism is in the locked position, the trigger lock is secured within the trigger guard and the gun cannot be discharged. When the trigger lock is inserted into a trigger guard of a gun and the lock mechanism is in the release position, the trigger lock is removable from the trigger guard. The trigger lock has a keyway into which a key may be engaged for moving the lock mechanism between the locked and release positions. The key is adapted to be secured to a user's hand.

Also disclosed herein is a one-piece trigger lock in which the key engages the keyway to move the lock mechanism between the locked and release positions by pressing against the keyway. The key may engage the keyway in any orientation, or may be limited to specific orientations when engaging the keyway. Or, the key may engage the keyway to free the lock mechanism to move between the locked and release positions by rotating or otherwise moving inside the keyway.

In addition, the lock mechanism may slide in one direction from the locked position to the release position and may slide in the opposite direction from the release position to the locked position. Or, the lock mechanism may slide in either direction from the locked position to the release position. Or, the lock mechanism may comprises a hinge, allowing the lock mechanism to swing from the locked position to the release position on the hinge.

The trigger lock may also comprise at least one safety or anti-picking feature. Such safety feature may include multiple lock-pins. The lock-pins may have very narrow tolerances to further increase the difficulty of picking the lock. The key-keyway relationship is non-standard, meaning that the key does not look like a common key and similarly the lock does not look like a common lock, which may make picking the lock more difficult. Also, the trigger lock may be structured and arranged so that it cannot be disassembled unless the trigger lock is in the unlocked position. In addition, the trigger lock may be structured and arranged so that there is no obvious place to cut the trigger lock away from the trigger area of a gun using cutters. An additional safety feature may include a behind-the trigger wedge which blocks the trigger from being depressed. In addition, the behind-the-trigger wedge may be longer than the length of the lock mechanism so that the behind-the-trigger wedge inserts behind the trigger before the lock mechanism is placed. This may prevent the trigger from being depressed as the trigger lock is being inserted into the trigger guard.

Also disclosed herein is a lock movable between a locked position and a release position comprising a key adapted to be secured to a user's hand; a keyway into which a key may be engaged to move a lock mechanism between a locked and a release position; wherein the key engages the keyway to move the lock mechanism between the locked and release positions by pressing against the keyway.

In addition, a method for using the trigger lock is disclosed herein. The method includes the steps of releasing the locking mechanism of the trigger lock, moving the trigger lock from the locked to the release position, pushing the trigger lock away from the trigger guard area of a gun, and placing the trigger finger inside the trigger guard area in one swift, fluid, easy motion.

The foregoing and other features and advantages of the invention will be apparent from the following more particular description of preferred embodiments of the invention, as illustrated in the accompanying drawings.

BRIEF DESCRIPTION OF THE DRAWINGS

The embodiments of the present invention will hereinafter be described in conjunction with the appended drawings, wherein like designations denote like elements, and.

DETAILED DESCRIPTION OF THE EMBODIMENTS

Figure 1:
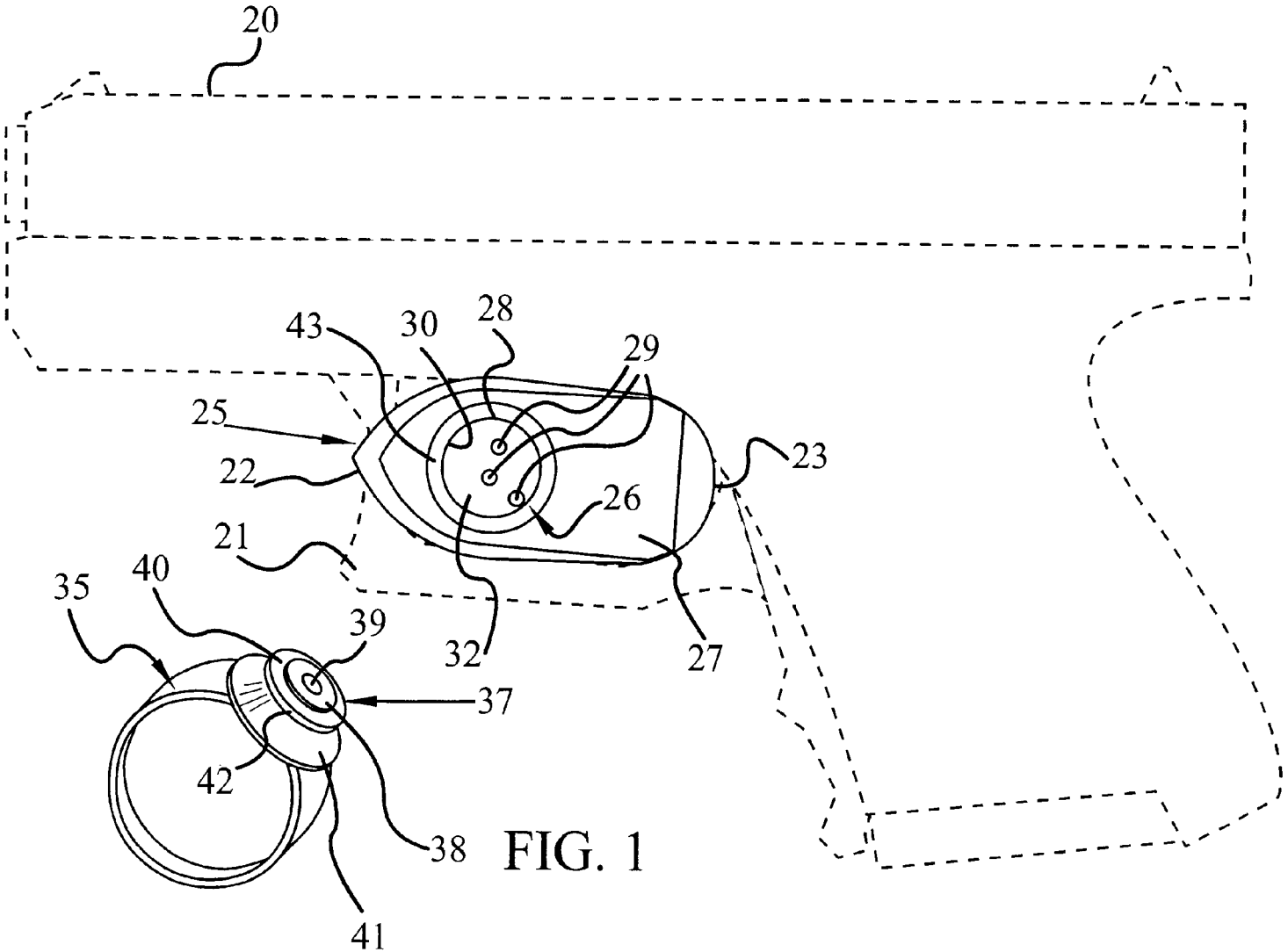
FIG. 1 is a side elevational view of a gun with the trigger lock engaged and the ring-key according to an embodiment of the present invention.

This invention relates to a trigger lock 25 for conveniently and quickly locking and unlocking a gun 20. The trigger lock 25 is a one-piece unit which slides into the trigger area of a gun and snaps into a locked position, preventing the trigger 50 from being depressed and preventing the gun from discharging. In one embodiment, the trigger lock 25 may be bullet-shaped to distinguish the front 22 of the trigger lock 25 from the back 23 of the trigger lock 25, making the proper insertion of the trigger lock into the trigger guard area easier. The trigger lock 25 can be unlocked and removed from the trigger area of the gun 20 by pressing a key 35 into the keyway 26, releasing the locking mechanism, and pushing the trigger lock 25 away from the trigger area in one smooth, rapid motion.

An embodiment of the trigger lock 25 can be disassembled, but only from the unlocked position. In this way, the trigger lock cannot be disassembled to remove it from its locked position in the trigger guard area of a gun. In addition, an embodiment of the trigger lock is made of solid metal material making it extremely difficult to cut the trigger lock away from a gun when the trigger lock is locked in a trigger guard area of a gun. Also, an embodiment of the trigger lock has multiple key elements which makes the trigger lock extremely difficult to pick (i.e. move from the locked to the release position without the key).

In addition, the key may be in the form of a ring. The ring-key 35 will either be available in different sizes, and the gun owner will choose the trigger lock according to his or her ring size, or the ring-key 35 will be adjustable to fit different sizes of fingers after purchase. The gun owner will wear the decorative ring-key 35. Because the ring-key 35 is worn on the gun owner's finger, curious children or other unauthorized users may not be able to unlock the firearm without the gun owner's knowledge. In addition, the gun owner will not have to spend time searching for a hidden key.

The trigger lock 25 may have safety features including a behind-the-trigger safety wedge 55 which prevents the trigger 50 from being pulled to discharge the gun when the trigger lock 25 is in place. The safety wedge 55 may be longer (i.e. have a longer wedge-length) than the body of the lock (lock-length) so that the safety wedge 55 is inserted behind the trigger 50 before the body of the lock 25 is inserted in front of the trigger 50, to prevent the gun 20 from discharging while inserting the trigger lock into place.

Turning to the figures, FIG. 1 illustrates the trigger lock 25 located in a gun 20. The gun 20 outlined in FIG. 1 is a representation of a GLOCK ® handgun 19 (available from GLOCK ®, 6000 Highlands Parkway, Smyrna, Ga. 30082), and the dimensions illustrated herein are designed to fit with GLOCK ® trigger guards. However, the size, shape, dimensions and features of the trigger lock can be adjusted to fit inside the trigger guard most guns.

FIG. 1 illustrates trigger lock 25 locked in trigger guard 21 of gun 20. Trigger lock 25 has a front 22 and a back 23. In FIG. 1, front 22 is slightly pointed, reminiscent of the front edge of a bullet. This shaping assists with distinguishing front 22 from back 23 when inserting trigger lock 25 into trigger guard 21. Alternatively, front 22 may be distinguished from back 23 by decorative indicia such as a logo engraved into or otherwise affixed at any location on the trigger lock 25. Decorative indicia may be added to trigger lock 25 for any purpose.

FIG. 1 also illustrates keyway 26. Keyway 26 comprises a circular key hole opening 28 in top surface 27 of trigger lock 25. Interior to key hole 28 is recessed key surface 32. Recessed key surface 32 may be recessed inside key hole 28 from top surface 27 of trigger lock 25. Extending upward from recessed key surface 32 are illustrated three key pins 29. Although three key pins 29 are illustrated, there may be more or fewer key pins 29. One skilled in the art will recognize that as more key pins are added, the difficulty of picking the lock is increased. For example, if the keyway 26 contained only one key pin 29, it may be possible to insert an object such as a screwdriver into the keyway 26, and press the key pin 29 down, while at the same time pushing the sliding lock plate 51 toward the release position (as illustrated in FIG. 3) so that as the key pin 29 moves to its unlock position, the sliding lock plate 51 is free to move to the release position (See FIG. 2). However, if there are multiple key pins 29, each with its own very specific unlock position with a very narrow tolerance, and in very close proximity to the next key pin 29 within keyway 26, the difficulty of using a tool or other object to hold each key pin 29 at its specific unlock position to pick the lock grows.

In addition, the placement or alignment of the key pins 29 within the keyway may increase the difficulty of picking the lock. If the key pins 29 are aligned along a plane perpendicular to the direction of movement of the sliding lock plate 51 (as illustrated by arrow 76 in FIG. 5), it may be more difficult to use the sliding lock plate 51 itself to assist with the picking of the lock. If multiple key pins 29 are aligned along a single plane, pressure applied against the sliding lock plate 51 could not act as a holding force to hold a single key pin 29 at its unlock position while moving on to the next key pin 29. In addition, if multiple key pins 29 are close together within the keyway 29, the difficulty of pushing individual key pins 29 to their individual unlock positions, holding the key pins 29 in place, and operating the sliding lock plate 51 is increased. The number of key pins 29 and their placement and alignment within the keyway constitute safety features.

FIG. 1 also illustrates ring-key 35. Ring-key 35 may also be in the form of other articles of jewelry such as a necklace-key. Ring-key 35 has a ring face 37 which is the top surface of ring-key 35. Ring face 37 of ring-key 35 may have annular layers 38 of varying thickness protruding from ring face 37. These annular layers 38 is a stepped laminar configuration structured and arranged to engage lock pins to drive the lock pins from a locked to a release position. In FIG. 1, ring face 37 has three annular layers, 38, 39 and 40 which may have three different thicknesses. As ring key 35 is pressed into keyway 26, an annular layer 38 aligns with a key pin 29 and depresses its corresponding key pin 29 to an unlocking position. As will be understood by one of ordinary skill in the art, and as will be discussed in more detail, depression of annular layers 38, 39 and 40 against their corresponding key pins 29 represent an element of the locking mechanism 45 of the trigger lock 25.

Also illustrated in FIG. 1 is an annular flange 41 on ring-key. Annular flange 41 may be complimentary to a corresponding angled surface 42 at the top of keyhole opening 28 in trigger lock 25. Annular flange 41 may assist with setting ring-key 35 into keyway 26 and directing ring-key 35 toward its proper position inside keyway 26. Annular flange 41 may have additional complimentary key elements which may be complimentary to key elements in angled surface 43 which may allow ring-key 35 to snap into place inside keyway 26. These complimentary key elements may include threading, scallops, geometric connectors or complimentary ratchets. In addition, complimentary key elements may be incorporated into the vertical surface 42 of ring face 37 or annular layer 38 which may be complimentary to key elements in side wall 30 of keyway 26.

FIG. 1 illustrates that ring-key 35 is circular and has annular layers 38, 39 and 40 of varying height which, when engaged into circular keyway 26, press against key pins 29. As illustrated in FIG. 1, ring-key 35 can engage into keyway 26 in any orientation. That is, the user does not need to be careful to align ring-key 35 in any particular orientation when inserting ring-key 35 into keyway 26. In addition, as illustrated in FIG. 1 and discussed below, the trigger lock 25 can be unlocked by simply pressing the ring-key 35 into keyway 26. There is no need to rotate, twist, or otherwise move ring-key 35 once it is pressed into keyway 26 to unlock trigger lock 25. This any-orientation feature makes the trigger lock 25 easy to unlock. Keyway 26 may have a non-circular opening such as square, oval, etc. If keyway 26 is not circular, ring-key 35 can engage into keyway 26 in only limited orientations.

Ring-key 35 may engage into keyway 26 to unlock trigger lock 25 in any of a multitude of well-known locking mechanisms. Well-known locking mechanisms may include electronic locks, magnetic locks or mechanical locks. Electronic locks may include locks employing identification technology such as fingerprints, DNA, electronic identification tags or chips, or other identification features. Magnetic locks may employ a magnet in the ring-key or a magnet in the keyway which may operate to pull or push springs or pins away from a locked position into a release position. Mechanical locks may operate to rotate, press, twist, push, pull, or otherwise move pins or springs away from a locked position into a release position. Mechanical locks may employ pins or other types of connection systems such as threading, geometric connectors, complimentary ratchets, ball bearings which engage against a scalloped edge or other connection systems to allow key to connect into keyway 26.

Figure 2:
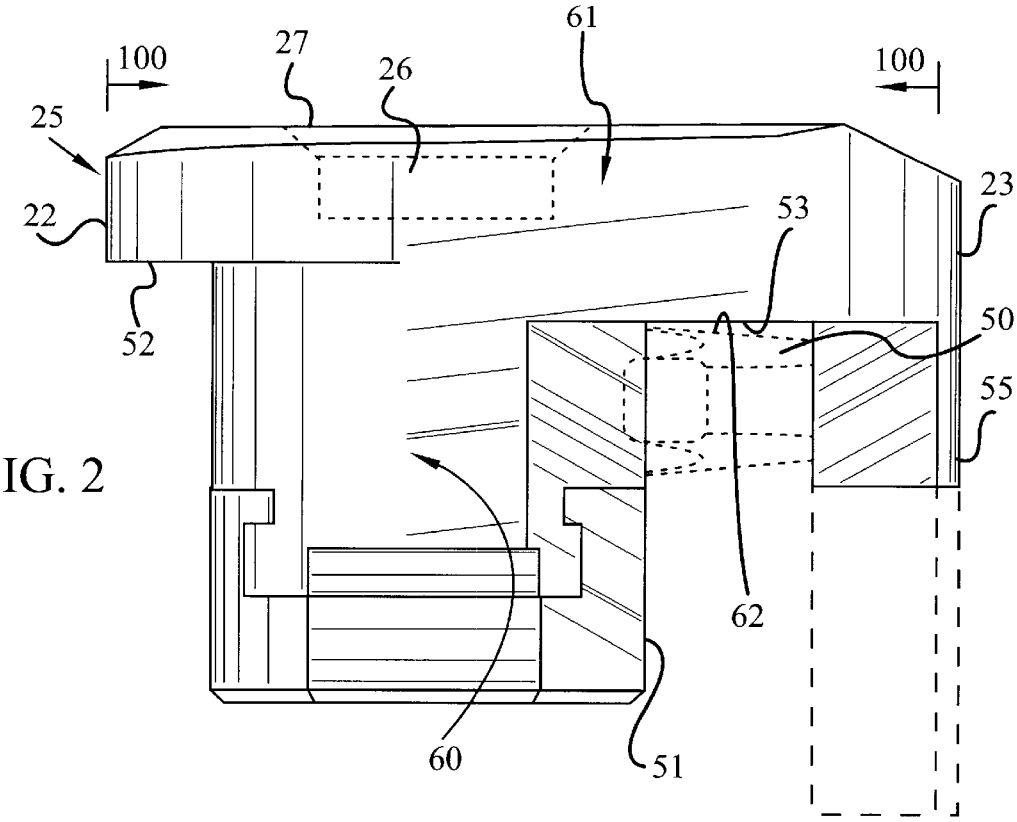
FIG. 2 is a side elevational view of the trigger lock with a trigger (in phantom), in the unlocked position, according to an embodiment of the present invention.
Figure 3:
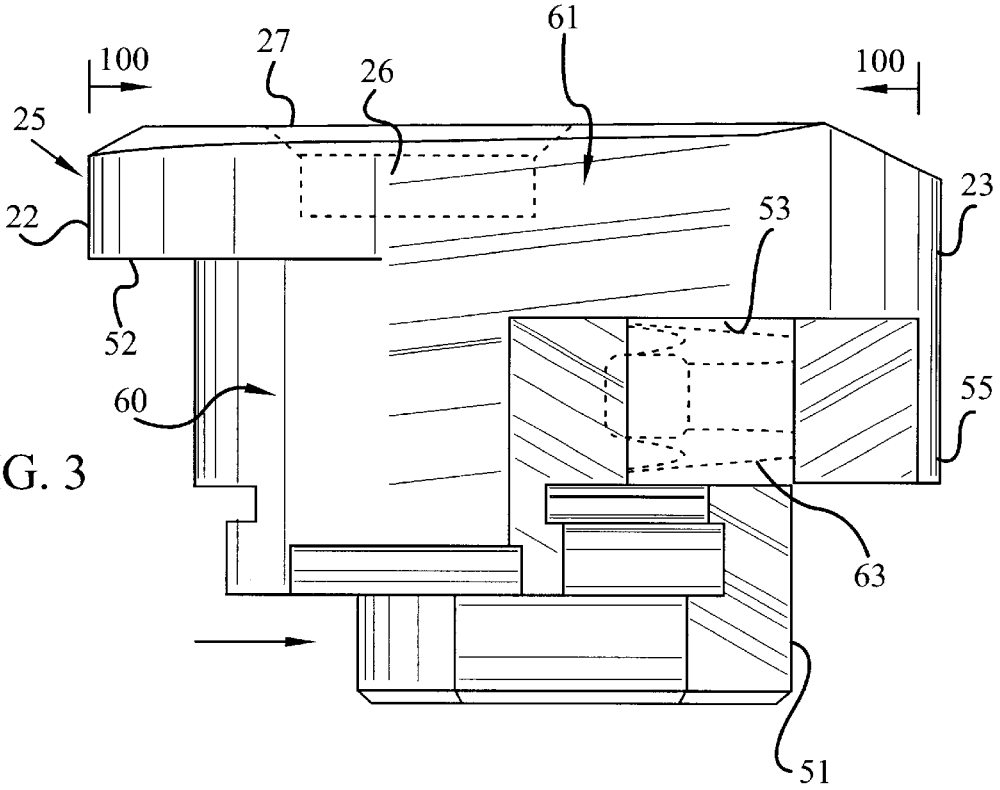
FIG. 3 is a side elevational view of the trigger lock with a trigger (in phantom), in the locked position, according to an embodiment of the present invention.

FIG. 2 is a side elevational view of trigger lock 25 in the unlocked position, with a trigger 50 (in phantom). The unlocked position is the release position. FIG. 3 is a side view of trigger lock 25, in the locked position, with trigger 50. FIGS. 2 and 3 illustrate trigger lock body 60 and trigger lock top 61. Front 22 of trigger lock top 61 has a trigger guard surface 52. When trigger lock 25 is placed into a trigger guard area of a gun, trigger guard surface 52 rests against the trigger guard 21 (see FIG. 1) of trigger lock 25. Back 23 of trigger lock top 61 has a trigger surface 53. When trigger lock 25 is placed into a trigger guard area of a gun, trigger surface 53 rests against a trigger lock top side 62 of trigger 50. The size and shape of trigger lock top 61, from front 22 to back 23, between top surface 27 and trigger guard surface 52 and between top surface 27 and trigger surface 53 can be adjusted so that trigger lock 25 can fit snugly against a trigger and a trigger guard of most guns. Keyway 26 is illustrated in dashed lines extending down from the top surface 27 of trigger lock 25 into trigger lock top 61.

FIGS. 2 and 3 also illustrate safety wedge 55. Safety wedge 55 fits behind trigger 50 to prevent trigger 50 from being depressed while trigger lock 25 is in place. For example, in the absence of safety wedge 55, it might be possible to insert a screw driver between trigger lock 25 and trigger 50 to depress trigger 50 and discharge the gun even while trigger lock 25 is in place. Safety wedge 55 prevents this action. In some guns, there may not be sufficient space behind the trigger to accommodate safety wedge 55. In trigger locks 25 designed for these guns, safety wedge 55 may not be present on trigger lock 25.

Safety wedge 55 also prevents trigger 50 from being depressed, and the gun discharging, as trigger lock 25 is being placed into the trigger guard area of a gun. As trigger lock 25 is being placed into the trigger guard area of a gun, safety wedge 55 slides into place behind trigger 50 as trigger lock 25 slides into place in front of trigger 50, thereby preventing trigger lock itself from depressing trigger 50 and discharging the gun before the rest of trigger lock 25 is engaged into the trigger guard area of the gun. Safety wedge is a safety feature of the trigger lock.

FIG. 2 also illustrates that safety wedge 55 may be elongated (dashed lines). When elongated, safety wedge 55 engages behind trigger 50 before the rest of trigger guard 25 slides into place in front of trigger 50. In other words, the length of the lock body 60, or lock-length is shorter than the length of safety wedge 55, or wedge-length. In this way, safety wedge 55 prevents trigger 50 from being depressed by trigger lock 25 while trigger lock 25 is being inserted into the trigger area of a gun. Therefore, elongated safety wedge 55 is an additional safety feature, which prevents trigger 50 from being depressed during the placement of trigger lock 25 into the trigger guard area of a gun.

FIG. 3 illustrates sliding lock plate 51 in the locked position. Sliding lock plate 51 can slide from the unlocked position (as illustrated in FIG. 2) to the locked position (as illustrated in FIG. 3) (as illustrated by the arrow in FIG. 3) without engaging ring-key 35 into keyway 26. Alternatively, sliding lock plate 51 can slide in either direction, or can rotate about a hinge. As illustrated in FIG. 3, once in the locked position, trigger 50 is inaccessible to a finger or any other object in the trigger area of the gun. Trigger 50 cannot be accessed from the front because the body of trigger lock 25 obstructs access to trigger 50 from the front. Trigger 50 cannot be accessed from the back because safety wedge 55 obstructs access to trigger 50 from the back. Trigger 50 cannot be accessed from either side because trigger surface 53 of trigger lock 25 and sliding lock plate 51 obstruct access to trigger from the sides. This inaccessibility constitutes a safety feature.

In addition, each of these structures, sliding lock plate 51, safety wedge 55, trigger lock top 61 and trigger lock body 60, are constructed of solid metal material such as aluminum or brass or steel. Trigger lock 25 could also be constructed of hard plastic material, such as the material used to construct gun grips or other hard solid material which is not easily broken. The solid nature of these structures, and their tight contact with trigger guard 21 and trigger 50 of the gun make it extremely difficult for potential unauthorized user of the gun would be able to cut the trigger lock away from the gun, once the trigger lock 25 is engaged and locked. The solid nature of the trigger-surrounding structures, their construction out of solid hard material such as metal, and their placement in tight contact with the trigger and trigger guard of the gun, constitute an anti-cutting-away safety feature.

To lock trigger lock, a user slides the unlocked trigger lock 25 in place in the trigger area of a gun and slides the sliding lock plate 51 from the unlocked position to the locked position. In the locked position, trigger 50 is surrounded by trigger lock top 61, safety wedge 55, trigger lock body 60, and top surface 63 of sliding lock plate 51. To unlock trigger lock 25, a user, wearing the ring-key 35 on the non-shooting hand, could press ring-key 35 into keyway 26, use the trigger finger of the shooting hand to snap sliding lock plate 51 from the locked position of FIG. 3 to the unlocked position of FIG. 2 and push trigger lock 25 out of the trigger guard area, catch trigger lock 25 with the non-shooting hand, slide the trigger finger of the shooting hand into the trigger guard area and be ready to discharge the gun in one smooth, fluid, rapid motion. Alternatively a user, wearing the ring-key 35 on the shooting hand, could insert ring-key 35 into keyway 26, rotate or otherwise engage ring-key 35 in keyway 26 to unlock trigger lock 25, and proceed as discussed above. The trigger lock can be inserted, locked, unlocked and removed interchangeably by a left-handed or right-handed user using a shooting or non-shooting hand to insert the trigger lock 25.

Figure 4:
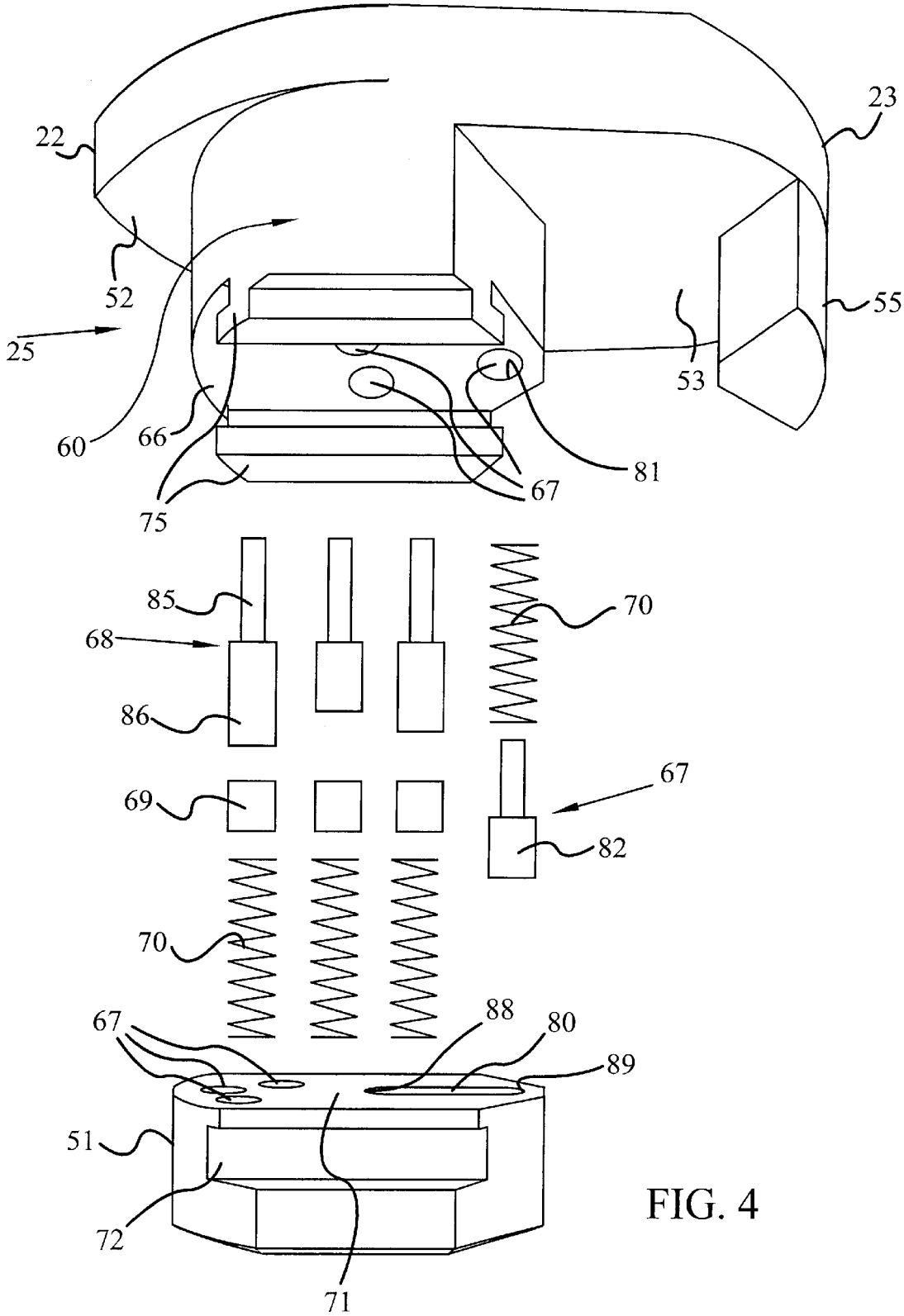
FIG. 4 is an exploded view of the trigger lock, according to an embodiment of the present invention.

FIG. 4 is an exploded view of trigger lock 25. FIG. 4 illustrates trigger lock body 60, bullet-shaped front 22 of trigger lock 25, back 23 of trigger lock 25 and safety wedge 55. Trigger lock body 60 is constructed of solid material. FIG. 4 also illustrates trigger guard surface 52, and trigger surface 53 of trigger lock body 60. On the bottom surface of trigger lock body 60 is lock body pin surface 66. Trigger lock body 60 pin surface 66 contains multiple lock pin holes 67. These lock pin holes 67 are cylindrical holes drilled into solid trigger lock body 60 to contain lock pins 68. Extending from lock body pin surface 66 are two flanges 75. Flanges 75 are complimentary to flange grooves 72 on two sides of sliding lock plate 51.

Sliding lock plate 51 is also constructed of solid material. Sliding lock plate 51 has a lock plate pin surface 71. Lock pin holes 67 are drilled into lock plate pin surface 71. Lock plate pin surface 71 also has a slide groove 80. As sliding lock plate 51 moves from the unlocked to the locked position, flanges 75 of trigger lock body 60 move slidingly within flange grooves 72 of sliding lock plate 51. Alternatively, slide groove 80 may be located on trigger lock body 60 and flanges 75 may be located on sliding lock plate 51.

Figure 5:
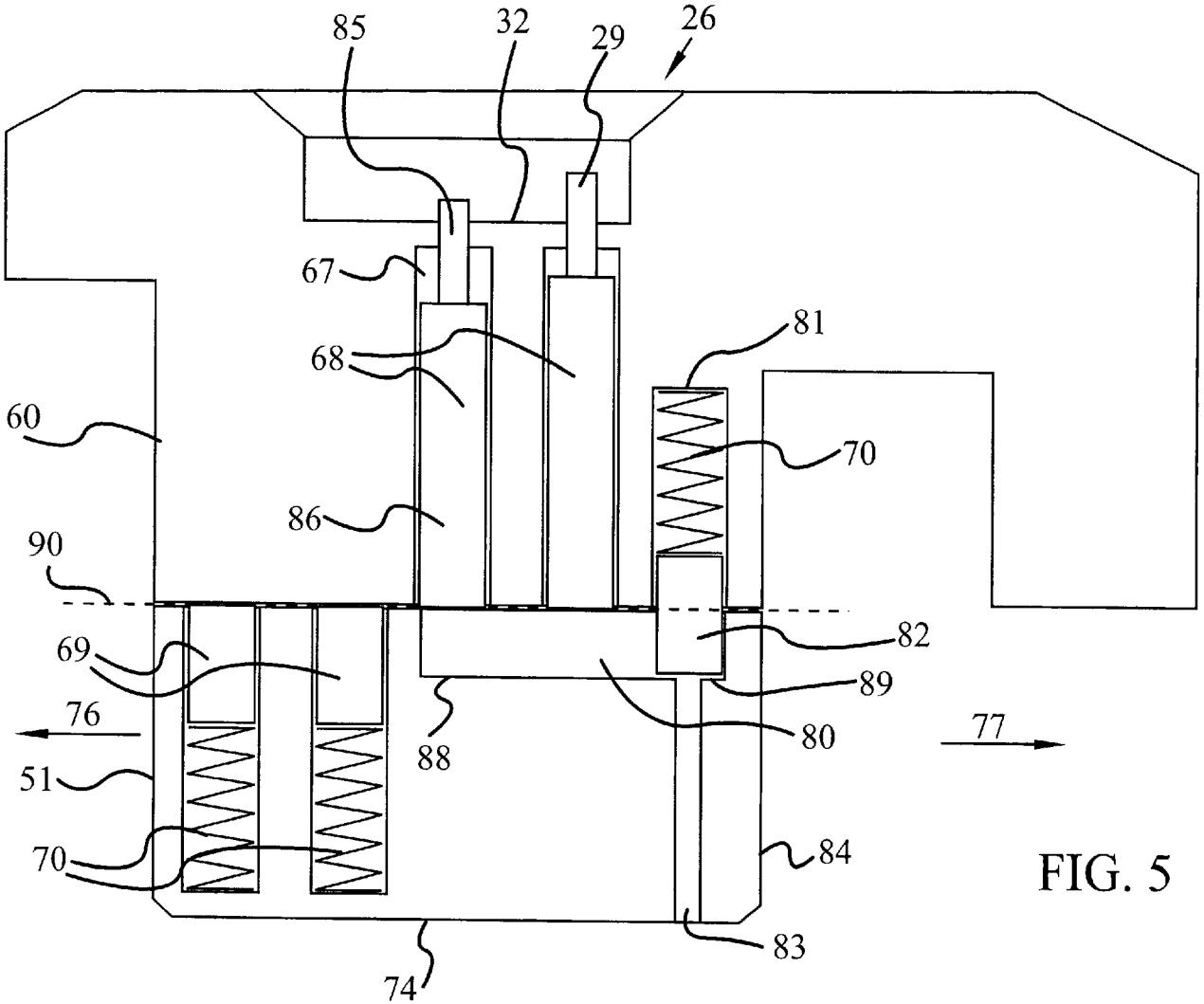
FIG. 5 is a section along line 100 in FIGS. 2 and 3 of the trigger lock in the unlocked position, according to an embodiment of the present invention.

FIG. 5 is a section along line 100 in FIGS. 2 and 3 of the trigger lock in the unlocked position, according to an embodiment of the present invention. FIG. 5 illustrates that, when assembled, lock pins 68 fit into lock pin holes 67 in trigger lock body 60. Lock pins have smaller diameter top ends 85 and larger diameter bottom ends 86. Top ends 85 of lock pins 68 extend upwards, through smaller diameter holes (not shown) through recessed key surface 32 of keyway 26 and are key pins 29 (see FIG. 1). Top ends 85 of lock pins 68 are held in place by larger diameter bottom end 86 of lock pins 68 which lodge against the inner surface of recessed key surface (not shown).

The lengths of the bottom ends 86 of lock pins 68 can be varied to vary lock combinations of trigger lock 25. Lock bits 69 also fit into lock pin holes 67. Lock bits 69 can be different lengths or the same lengths. Springs 70 also fit into lock pin holes 67. Top ends 85 are the same length so that when assembled, key pins 29 (which are top ends of lock pins 68) extending upward from recessed key surface 32 are all the same length.

One lock pin hole 67 in lock body pin surface 66 is aligned with slide groove 80 in lock plate pin surface 71 (See FIG. 4). This lock pin hole 67 is the slide pin hole 81. The lock pin 67 which is in the slide pin hole 81 is the slide pin 82. Slide pin 82 fits into slide groove 80 and presses into slide groove 80 by means of spring 70 in slide pin hole 81. Slide groove 80 has a locked end 88 and an unlocked end 89. As sliding lock plate 51 slides from the locked to the unlocked position, slide pin 82, extending downward into slide groove 80, slides from locked end 88 of slide groove 80 to unlocked end 89 of slide groove 80. As sliding lock plate 51 slides from the unlocked position to the locked position, slide pin 82, extending downward into slide groove 80, slides from unlocked end 89 to locked end 88 of slide groove 80. This movement of slide pin 82 in slide groove 80 defines the range of motion of the sliding lock plate 51 in relation to trigger lock body 60.

Alternatively, slide pin 82 could extend downward into a hole in sliding lock plate 51, forming a pivot point. In this embodiment, no flanges or flange grooves would be necessary. The sliding lock plate, in this case the swinging lock plate, could swing around the pivot point to move from the locked position to the unlocked position or from the unlocked position to the locked position. Alternatively, sliding lock plate could slide in either direction in relation to trigger lock body 60 to move from the locked to the release position.

In addition, locked end 88 of slide groove 80 and unlocked end 89 of slide groove 80 could contain a detent (not shown) to accept slide pin 82. Such a detent could cause sliding lock plate 51 to "snap" into position in the locked or unlocked position. This detent could assist the user to know by feel that the lock has been fully locked or fully unlocked.

Figure 6:
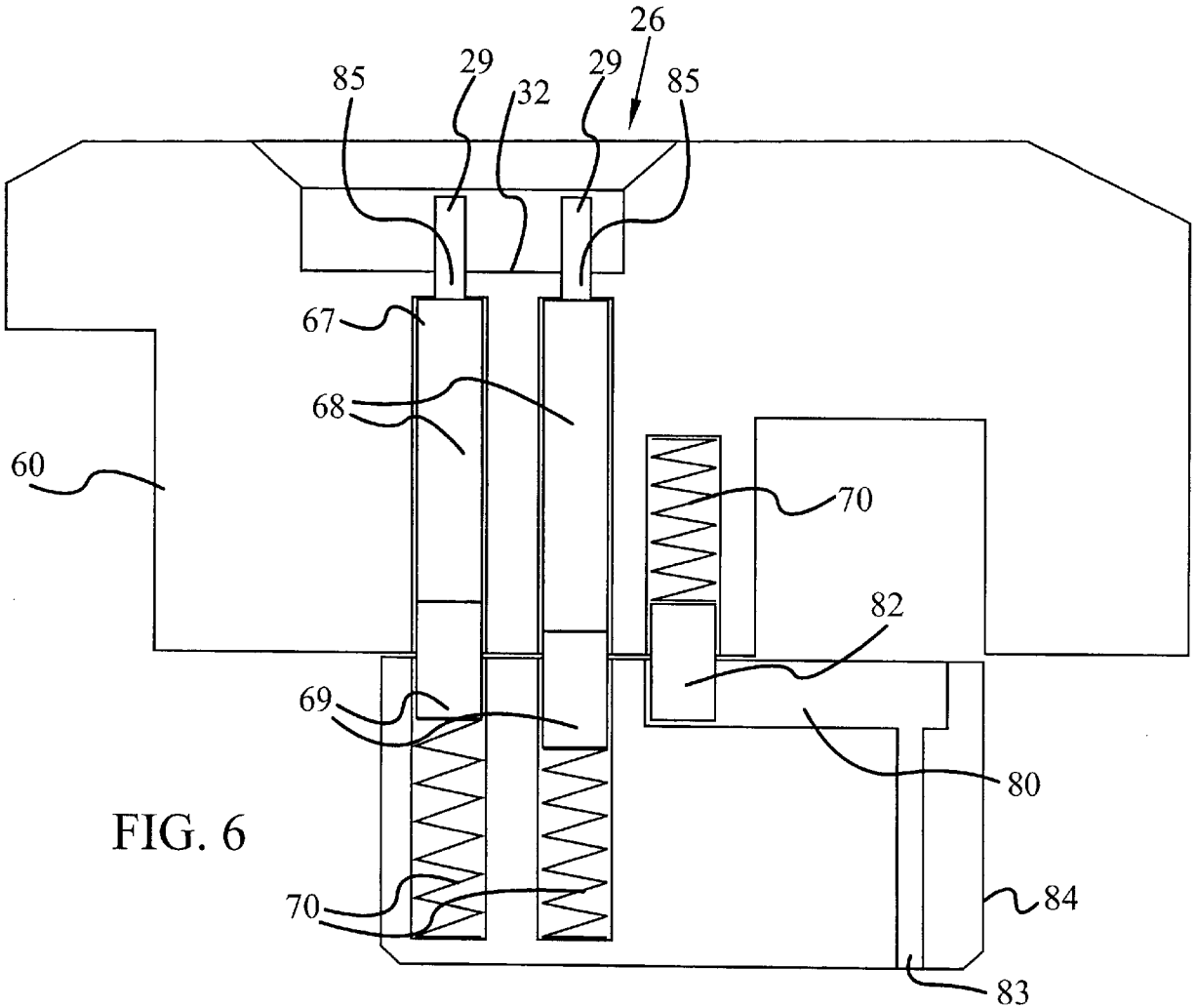
FIG. 6 is a section along line 100 in FIGS. 2 and 3 of the trigger lock in the locked position, according to an embodiment of the present invention.

FIG. 5 also illustrates that slide groove 80 also has a pin hole 83 located at the back end 84 of sliding lock plate 51. Unlike the sliding lock plate 51 lock pin holes 67, slide groove 80 pin hole 83 extends all the way through the bottom surface 74 of sliding lock plate 51. In the locked position, this slide groove 80 pin hole 83 creates a hole which extends all the way through sliding lock plate 51 (see FIG. 6). A wire extended into the slide groove pin hole 83 when in the locked position would pass through sliding lock plate 51 without coming in contact with trigger lock body 60. In the unlocked position, as illustrated in FIG. 5, the slide groove pin hole 83 aligns with the corresponding slide pin hole 81 in trigger lock body 60. FIG. 5 illustrates that in the unlocked position, slide pin 82 and a spring 70 are in slide pin hole 81. To disassemble trigger lock 25, a compatible rod, length of wire or other long, thin material can be threaded through slide groove pin hole 83 from the bottom surface 74 of sliding lock plate 51 to push against slide pin 82 and compress spring 70 so that slide pin 82 aligns with shear line 90 to allow sliding lock plate 51 to slide all the way off of trigger lock body 60 in the direction shown by arrow 76. This constitutes a disassembly system. In this way, disassembly of the trigger lock 25 is possible. However, disassembly of the trigger lock is only possible when the trigger lock 25 is in the unlocked position. In the locked position, as shown in FIG. 6, slide groove pin hole 83 is not aligned with slide pin hole and no amount of prodding into slide groove pin hole 83 will release the sliding lock plate 51. This ability to disassemble the trigger lock only when the trigger lock is in the unlocked position constitutes a safety feature.

FIG. 5 illustrates lock pins 68, lock bits 69 and springs 70 as they fit into lock pin holes 67 when trigger lock 25 is assembled in the unlocked position with slide lock plate 51 in place. FIG. 5 illustrates top ends 85 of lock pins 68 extending upwards, through recessed key surface 32 of keyway 26. In the unlocked position, sliding lock plate 51 lock pin holes 67 are not aligned with trigger lock body 60 lock pin holes 67. In the unlocked position, sliding lock plate 51 lock pin holes 67 contain springs 70 and lock bits 69. In the unlocked position, springs 70 are compressed. Lock pins 68 are in trigger lock body 60 lock pin holes 67 in the unlocked position. As shown in FIG. 5, in the unlocked position, sliding lock plate 51 can slide unobstructed in the direction of the arrow 92 toward the locked position.

As sliding lock plate 51 slides in the direction indicated by arrow 92 from the unlocked position to the locked position, sliding lock plate 51 lock pin holes 67 come into alignment with trigger lock body 60 lock pin holes 67. As lock pin holes 67 in sliding lock plate 51 and trigger lock body 60 come into alignment, springs 70 push lock bits 69 against lock pins 68 and push lock pins 68 outward into keyway 26. This locked configuration is illustrated in FIG. 6. FIG. 6 is a section along line 100 in FIGS. 2 and 3 of the trigger lock in the locked position, In the locked position, lock pins 68 are fully extended and lock bits 69 sit across shear line 90. When lock bits 69 are across shear line 90, lock bits 69 obstruct the movement of sliding lock plate 51 in relation to trigger lock body 60. This is the lock mechanism 45.

When ring-key 35 is pushed against lock pins 68, extending upward from recessed key surface 32 of keyway 26, ring-key pushes against lock pins 68, which compresses springs 70. Annular layers 38 of ring-key 35 (see FIG. 1) are at just the proper height to compress lock pins 68 so that bottom of lock pins 68 and the top of lock bits 69 are aligned with shear line 90. When the bottom of lock pins 68 and the top of lock bits 69 are aligned at shear line 90, sliding lock plate 51 can slide back in to the unlocked position. Slight variations in the height of the annular layers 38 of ring-key 35 and their associated lock pins 68 accomplish variability in the keying of the trigger lock 25. Variations as small as one five-hundredth of an inch may be sufficient to change the keying of the trigger lock 25. These small tolerances make the trigger lock more difficult to pick and constitute a safety feature.

The trigger lock system may be preferably made of brass, aluminum, steel, or other metal materials, hard plastic (similar to the plastic used by gun manufacturers such as GLOCK ® in their grips), or other plastic material. The ring-key may be made of any of these materials or jewelry grade metal such as brass, silver, gold, gold alloy or plastic.

While the invention has been particularly shown and described with reference to preferred embodiments thereof, it will be understood by those skilled in the art that various changes in form and details may be made therein without departing from the spirit and scope of the invention.

I claim:

1. A trigger lock adapted to be inserted into a trigger guard of a gun comprising:

a lock mechanism movable between a locked position and a release position, said lock mechanism comprising lock pins;

wherein when the lock mechanism is in the locked position, the trigger lock is secured within the trigger guard substantially blocking movement of a trigger and wherein when the lock mechanism is in the release position, the trigger lock is removable from the trigger guard;

a keyway in said lock into which a key may be engaged for moving the lock mechanism between the locked and release positions; and a ring-key adapted to be secured to a user's hand for engaging said keyway wherein the key engages the keyway to move the lock mechanism between the locked and release positions by pressing against the keyway.

2. A trigger lock as in claim 1 wherein said ring-key comprises a stepped laminar configuration structured and arranged to engage lock pins to drive the lock pins from a locked to a release position.

3. A trigger lock as in claim 1 wherein the ring-key comprises an annular flange.

4. A trigger lock as in claim 3 wherein the annular flange is structured and arranged to guide said ring-key into said keyway.

5. A trigger lock as in claim 1 wherein the key engages the keyway in any orientation.

6. A trigger lock as in claim 1 wherein the key engages the keyway in a limited number of orientations.

7. A trigger lock as in claim 1 further comprising at least one safety feature.

8. A trigger lock as in claim 7 wherein the safety feature comprises a behind-the-trigger wedge.

9. A trigger lock adapted to be inserted into a trigger guard of a gun comprising:

a lock mechanism movable between a locked position and a release position;

wherein when the lock mechanism is in the locked position, the trigger lock is secured within the trigger guard substantially blocking movement of a trigger and wherein when the lock mechanism is in the release position, the trigger lock is removable from the trigger guard;

a keyway in said lock into which a key may be engaged for moving the lock mechanism between the locked and release positions; and, a key adapted to be secured to a user's hand for engaging said keyway wherein the safety feature comprises multiple key pins.

10. A trigger lock as in claim 7 wherein the safety feature comprises a disassembly system which is only useable when the trigger lock is in the unlocked position.

* * * * *